US006547240B2

(12) United States Patent
Silberbauer

(10) Patent No.: US 6,547,240 B2
(45) Date of Patent: Apr. 15, 2003

(54) GRIPPER DRUM FOR GRIPPING PRINTED PRODUCTS

(75) Inventor: Günther Silberbauer, Oftringen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/838,559

(22) Filed: Apr. 20, 2001

(65) Prior Publication Data

US 2002/0060424 A1 May 23, 2002

(30) Foreign Application Priority Data

Apr. 20, 2000 (EP) ..... 00810350

(51) Int. Cl.[7] ..... B65G 39/02
(52) U.S. Cl. ..... 271/277; 271/82
(58) Field of Search ..... 271/277, 275, 271/187, 82; 270/52.14

(56) References Cited

U.S. PATENT DOCUMENTS 3,806,111 A * 4/1974 Lachman et al. ..... 270/52.28
3,960,079 A 6/1976 Capetti
4,241,907 A 12/1980 McCain et al.
4,299,378 A * 11/1981 Muller ..... 270/52.27
4,564,186 A * 1/1986 Clarke et al. ..... 270/52.29
4,681,213 A 7/1987 Winiasz
6,308,945 B1 * 10/2001 Sagesser ..... 270/52.27

FOREIGN PATENT DOCUMENTS

CH 652 103 10/1985

* cited by examiner

*Primary Examiner*—Joseph E. Valenza
*Assistant Examiner*—Mark A. Deuble
(74) *Attorney, Agent, or Firm*—Venable LLP; Robert Kinberg; Chad Anderson

(57) ABSTRACT

A gripper drum for gripping printed products includes a drum shaft; at least one gripper disk coupled to the drum shaft; a gripper shaft disposed on the at least one gripper disk and having a shaft body rotatable about its longitudinal axis; an apparatus for controlling the gripper shaft; and a plurality of grippers disposed on the shaft body. The grippers are adaptable to be rotated about the longitudinal axis of the gripper shaft for gripping the printed products. The gripper drum further includes a tensing apparatus coupled to the gripper shaft for compensating any play between the controlling apparatus and the plurality of grippers. The gripper drum operates to define an opening movement and closing movement of the grippers.

8 Claims, 3 Drawing Sheets

GRIPPER DRUM FOR GRIPPING PRINTED PRODUCTS

CROSS-REFERENCE TO RELATED APPLICATIONS

Priority is claimed with respect to European Patent Application 00810350.9 filed on Apr. 20, 2000, the disclosure of which is incorporated herein by reference.

BACKGROUND OF THE INVENTION

The invention relates to a gripper drum having a gripper shaft for gripping printed sheets.

Gripper shafts of this type in a sheet feeder serve to draw sheets or inserts from a stack and transfer them to an opening apparatus. A sheet feeder having two such gripper shafts is described and illustrated in, for example, Swiss patent document CH 652 103 A5 owned by the assignee of the present application. To grip the sheets, the gripper shaft is rotated about its longitudinal axis. During this rotational movement, grippers disposed on the gripper shaft grip a respective sheet on the underside of the stack, and press it against a support surface of the gripper drum. A drive having a spur gear and a closed cam, for example, is provided for rotating the gripper shaft.

During each closing process, the gripper shaft is accelerated, and its direction changes due to the play or looseness at the cam track and the toothing of the spur gear. After the turning point, the gripper shaft is inclined to rotate further, and the play is shifted to the oppositely-located outer side of the cam. If the grippers now impact the support surface of the gripper drum, the gripper shaft springs back within the play region. Notably, this causes the grippers to release thin printed sheets temporarily, after which they can no longer grip the sheets properly. This brief release may cause printed sheets to be drawn askew. Furthermore, the printed sheets can slide away from the grippers and cause an operation shutdown. Particularly in a high-output operation, the conventional gripper shaft is susceptible to disturbances of this type, which can result in a significant drop in the net output.

SUMMARY OF THE INVENTION

It is therefore an object of the invention to embody a gripper drum of the type that avoids the aforementioned disadvantages, yet can be produced inexpensively.

The object is accomplished by a gripper drum for gripping printed products which includes a drum shaft; at least one gripper disk rotatable about an axis and coupled to the drum shaft; a gripper shaft disposed on the at least one gripper disk and having a shaft body rotatable about its longitudinal axis; means for controlling rotation of the gripper shaft; a plurality of grippers disposed on the shaft body, wherein the plurality of grippers are adaptable to be rotated about the longitudinal axis of the gripper shaft for gripping the printed products; and a tensing apparatus coupled to the gripper shaft for compensating play between the controlling means and the plurality of grippers, whereby the gripper drum operates to define an opening movement and closing movement of the grippers.

In the gripper drum according to the present invention, the tensing apparatus compensates the play or looseness in the region of the toothing and the closed cam apparatus that controls the rotation of the gripper shaft. During a closing movement, a counter-moment of, for example, 6 Newton meters (Nm) is built up in the tensing apparatus. This counter-moment prevents the grippers from jumping or springing back from the opposing support surface, and can assure a gentle closing movement for grasping the printed products. The printed sheets can therefore be drawn off from the underside of a stack in a stable, secure position to result in a more reliable gripping process. This is also the case for a stack having a very high stack pressure, in which a correspondingly high gripping force is necessary. The reliable gripping process assures a higher net output and, accordingly, fewer disturbances in operation.

The gripper drum according to the present invention is especially well-suited for a sheet feeder. Other applications are also conceivable, however, in which any type of printed sheet or material can be gripped by the closing movement.

In accordance with a modification of the present invention, during each closing process, the tensing apparatus or energy accumulator includes a compensation spring that is tensed by a pivot lever, which is secured, fixed against relative rotation, to the shaft body of the gripper shaft, resulting in a particularly simple structural embodiment. The compensation spring is preferably connected to the gripper shaft and the shaft of the gripper drum. The compensation spring is automatically tensed when the gripper shaft rotates. The tension can be adjusted simply by changing the position of the pivot lever on the gripper shaft.

BRIEF DESCRIPTION OF THE DRAWINGS

Further advantageous features ensue from the following descriptions and the drawings. A preferred embodiment of the invention is described in detail below in conjunction with the drawings.

DETAILED DESCRIPTION OF THE INVENTION

Figure 1:
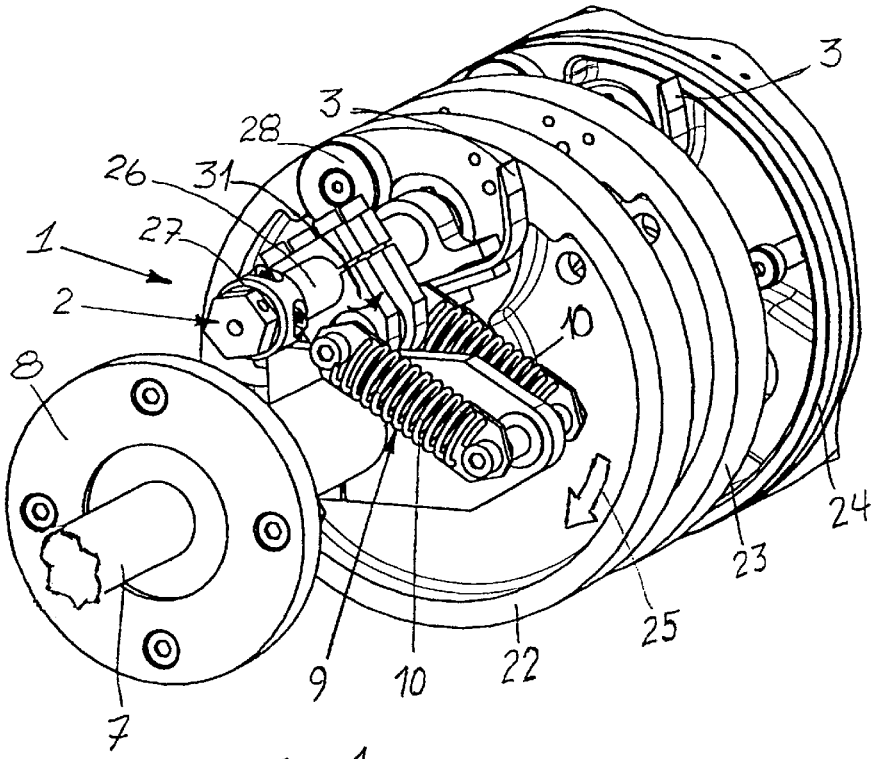
FIG. 1 is a partial side view of a gripper drum according to the invention, having a gripper shaft, with the gripper shaft being located in the inoperative, open position.
Figure 2:
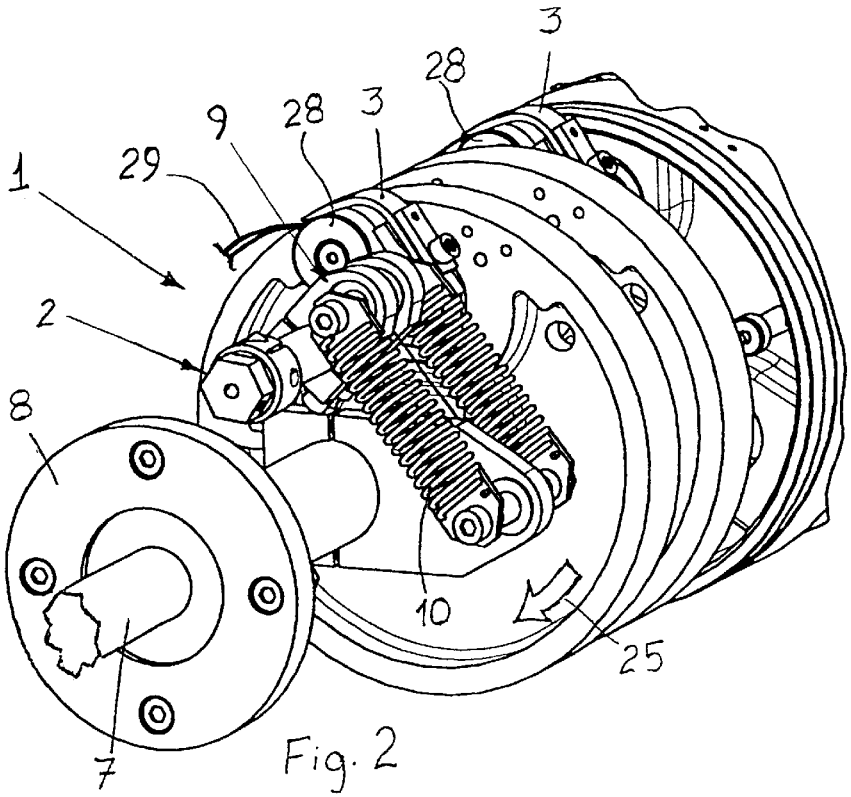
FIG. 2 is the gripper drum according to FIG. 1, but with the gripper shaft being located in the operative, closed position.

FIGS. 1 and 2 illustrate a gripper drum 1, which is disposed in a sheet feeder that is otherwise not shown, and is driven by drum shaft 7. The gripper drum 1 is seated on a machine stand, not shown, with flange bearings 8, of which only one is shown here. A plurality of gripper disks 22, 23, 24 are disposed on the drum shaft 7, with a gripper shaft 2 that can rotate to a limited extent being seated on the disks, with spacing from the drum shaft 7.

The gripper shaft 2 has a shaft body 26, on which a plurality of grippers 3 are secured so as to be fixed against relative rotation. FIGS. 1 and 2 only show two of these grippers 3, but the gripper drum of the present invention can be equipped with more than two grippers. A drive is configured such that the shaft body 26, with the grippers 3, executes a closing movement and an opening movement with each rotation of the gripper drum 1. The drive is disposed at one end of the gripper shaft 2, and the shaft body 26 can be rotated about its longitudinal axis in order to grip the printed products. The grippers 3 are shown in the inoperative, open position in FIG. 1, and in the operative, closed position in FIG. 2. During the closing movement, the grippers 3 are moved from the position shown in FIG. 1 into the position shown in FIG. 2. The movement is effected by a rotational movement of the shaft body 26 about its longitudinal axis. In the closing process, the shaft body 26 is tensed by a torsion spring that is connected to the shaft body 26. Such torsion springs are known to one of skill in the art.

In accordance with FIG. 2, during a closing movement, the grippers 3 are pressed against support surfaces 28, such as a peripheral jacket surface, and a printed sheet 29 indicated in FIG. 2 is thereby held by its fold. A printed sheet 29 held in this manner can be drawn from a stack, not shown here, due to the rotational movement of the gripper drum 1 in the direction of the arrow 25.

Figure 4:
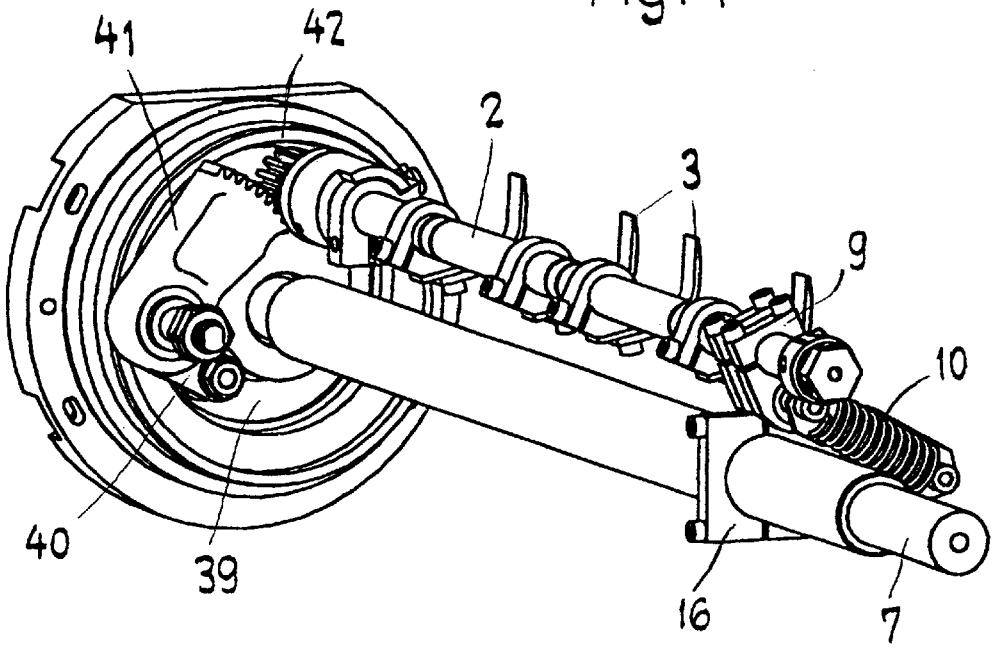
FIG. 4 is a partial side view of gripper drum of the present invention with the gripper disks removed.

As shown in FIG. 4, the grippers 3 are controlled by a control curve drive arrangement. The arrangement includes a control lever 40, a toothed segment 41 and a pinion 42. The pinion 42 is positioned on the gripper shaft 2. The control lever 40 and the toothed segment 41 rotate along with the gripper shaft 2 around the drum shaft 7. During operation, the control lever 40 and the toothed segment are positioned pivoting in a rotating disk, obscured in FIG. 4 by the control drive 39.

Figure 3:
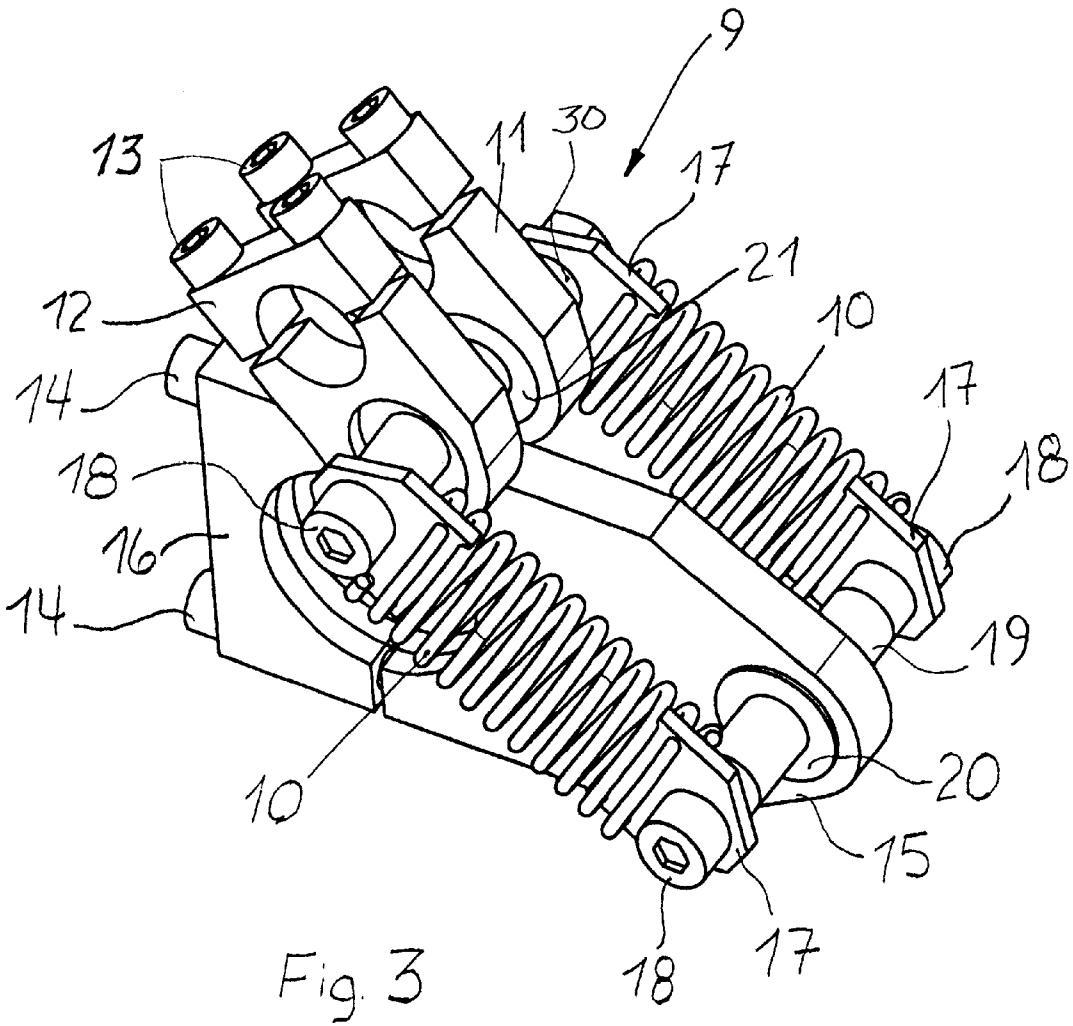
FIG. 3 is a spatial view of a compensation spring of the gripper drum of FIGS. 1 and 2.

Disposed between the shaft body 26 and the drum shaft 7 is a compensation spring 9 having two spring elements 10, which are disposed parallel to one another with spacing and are secured at each end to a shaft 19 and 30, respectively. As shown in FIG. 3, the spring elements are secured with fastening plates 17, which are respectively screwed to the shafts 19 and 30 with screws 18. The shaft 19 is rotatably seated in a bearing 20 of a retaining plate 15. The retaining plate 15 is connected, fixed against relative rotation, to the shaft 7 by means of a clamping part 16 and clamping screws 14. The shaft 30 is seated in a pivot bearing 21, which is likewise connected, fixed against relative rotation, to two pivot levers 11 that are securely connected by clamping parts 12 and clamping screws 13 to the shaft body 26. These two pivot levers 11 are embodied such that the two spring elements 10 are tensed in a closing movement of the gripper 3. This rotational movement is indicated by the arrow 31 in FIG. 1. The tension of the two spring elements 10 that is generated here acts as a torque, via the pivot levers 11, on the shaft body 26. This torque is a counter-moment to the torque pressing the grippers 3 against the support surfaces 28. The counter-moment has a value of, for example, 6 Nm. The torque pressing the grippers 3 is significantly greater, e.g., greater than 10 Nm. This counter-moment can compensate play in the drive 4 or in the drive gear.

For example, play can exist between a closed drive cam and a roller guided in this cam. If the play is compensated accordingly, the grippers 3 do not spring back from the support surfaces 28 during the closing movement. This assures a gentle closure. Furthermore, because the grippers do not spring back, the sheets 29 can be gripped more securely. The suitable counter-moment can be ascertained through experimentation. The counter-moment can be changed simply by releasing the pivot levers 11 and rotating them on the shaft body 26. The spring elements 10 are helical springs, however, it is apparent to one of skill in the art that the spring elements can also be embodied differently. The buildup of a counter-moment during a closing movement is crucial.

Because the compensation spring 9 can be produced from comparatively simple, inexpensive individual parts, the additional outlay is relatively small, and requires no maintenance.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A gripper drum for gripping printed products, comprising:

a drum shaft;

at least one gripper disk coupled to the drum shaft;

a gripper shaft disposed on the at least one gripper disk and having a shaft body rotatable about its longitudinal axis;

means for controlling rotation of the gripper shaft;

a plurality of grippers disposed on the shaft body, wherein the plurality of grippers are adaptable to be rotated about the longitudinal axis of the gripper shaft for gripping the printed products; and a tensing apparatus coupled to the gripper shaft for compensating play between the controlling means and the plurality of grippers, whereby the gripper drum operates to define an opening movement and closing movement of the grippers.

2. The gripper drum according to claim 1, wherein the controlling means includes a cam and a drive.

3. The gripper drum according to claim 1, wherein the tensing apparatus comprises an energy accumulator to create a counter-moment during a rotation of the shaft body.

4. The gripper drum according to claim 3, wherein the energy accumulator includes a compensation spring.

5. The gripper drum according to claim 4, wherein the compensation spring comprises at least one pivot lever coupled to the shaft body and at least one spring element coupled to the at least one pivot lever, wherein the at least one pivot lever is fixed against relative rotation of the shaft body and tenses the at least one spring element during the closing movement.

6. The gripper drum according to claim 1, further including a support surface, and wherein the grippers, in the closing movement, presses the printed sheets against the support surface.

7. The gripper drum according to claim 6, wherein the support surface is a peripheral jacket surface.

8. The gripper drum according to claim 7, wherein the at least one spring element includes at least one helical spring element having two ends, wherein one end is coupled to the shaft body of the gripper shaft and the other end is coupled to the drum shaft.

* * * * *